US010820678B2

(12) United States Patent
Karambatsos

(10) Patent No.: US 10,820,678 B2
(45) Date of Patent: Nov. 3, 2020

(54) PORTABLE APPARATUS FOR SUPPORTING A HAND HELD HAIR DRYER

(71) Applicant: Natasa Karambatsos, Brossard (CA)

(72) Inventor: Natasa Karambatsos, Brossard (CA)

( * ) Notice: Subject to any disclaimer, the term of this patent is extended or adjusted under 35 U.S.C. 154(b) by 0 days.

(21) Appl. No.: 15/470,878

(22) Filed: Mar. 27, 2017

(65) Prior Publication Data

US 2017/0273427 A1 Sep. 28, 2017

Related U.S. Application Data

(60) Provisional application No. 62/313,654, filed on Mar. 25, 2016.

(51) Int. Cl.

| | |
|---|---|
| ***F16M 11/00*** | (2006.01) |
| ***A45D 20/12*** | (2006.01) |
| ***A45D 20/14*** | (2006.01) |

(52) U.S. Cl.

CPC ..... *A45D 20/12* (2013.01); *A45D 20/14* (2013.01); *A45D 2020/126* (2013.01)

(58) Field of Classification Search

CPC ..... A45D 20/12; A45D 2020/126; A45D 2020/128; F26B 23/04

See application file for complete search history.

(56) References Cited

U.S. PATENT DOCUMENTS

| | | | | |
|---|---|---|---|---|
| 6,044,574 | A * | 4/2000 | Haghkhah | A45D 20/12 132/312 |
| 7,506,849 | B1 * | 3/2009 | Koster | A45D 20/12 248/214 |
| 2001/0020668 | A1 * | 9/2001 | Thomas | A45D 20/12 248/309.3 |
| 2003/0173483 | A1 * | 9/2003 | Yeh | A47G 7/044 248/287.1 |
| 2005/0167563 | A1 * | 8/2005 | Delaney | A45D 20/12 248/475.1 |

* cited by examiner

*Primary Examiner* — Amy J. Sterling
(74) *Attorney, Agent, or Firm* — Praxis

(57) ABSTRACT

A portable hair dryer support apparatus comprising a hair dryer holding structure for holding a hair dryer and at least one vertical support element connected at a first end to the hair dryer holding structure and having at a second opposed end at least one securing portion for securing the portable hair dryer support apparatus to a door.

16 Claims, 5 Drawing Sheets

PORTABLE APPARATUS FOR SUPPORTING A HAND HELD HAIR DRYER

CROSS-REFERENCE TO RELATED APPLICATIONS

This application claims the benefits of U.S. provisional patent application No. 62/313,654 filed on Mar. 25, 2016, which is herein incorporated by reference.

TECHNICAL FIELD

The present disclosure relates to a portable apparatus for supporting a hand held hair dryer. More specifically, the present disclosure relates to a portable apparatus for supporting a hand held hair dryer while the appliance is in use in order to free both of the user's hands for drying or styling of their hair.

BACKGROUND

Hair dryers are a common household appliance used by people to style their hair daily. Hair dryers are available in numerous sizes and styles, many of which are bulky and sometimes relatively cumbersome or heavy. This makes the dryer difficult to use and operate over an extended period of time for certain users when drying or styling their own hair. A user whose arm becomes tired from holding the dryer may not satisfactorily complete their desired hairstyle. Also, as the appliance becomes heavy a user may accidentally touch their scalp, ear or neck with the hot appliance causing injury. Individuals with motor-sensory limitations or the elderly sometimes experience difficulty manipulating blow dryers for any length of time.

Current solutions which purport to help support a blow dryer while it is operated by an individual present material challenges to the average user:

- Certain such hair dryer support mechanisms are comprised of mechanisms which are temporarily affixed to a wall with a suction cup. Suction-cup based solutions are often difficult to reliably use owing to a number of factors, which may include one or a combination of the following (i) wall dressings or materials which create a failure of the suction cup(s) to adhere to different walls, (ii) wall damage or discoloration resulting from the repeat affixing and removal of a suction cup to and from a wall, and (iii) limited amount of weight which such mechanisms can support before the suction cup collapses. The motor or blower section of some of the larger sized hair dryers will not often be comfortably held by such suction-based devices owing to their weight or dimension, and as a result such mechanisms can be awkward to use or cause damage to hair drying devices by falling to the floor when the supported device is beyond an excess weight.
- Certain hair dryer support mechanisms comprise a floor stand placed in a bathroom or other location, which extend at a perpendicular or near perpendicular angle from the floor to allow a user to place the blow dryer directly on a holster affixed to the top of such floor stand. These devices present practical issues, key amongst which is that they occupy floor space when not in use. A user may wish to use the limited space in his or her washroom or other room for items other than a blow dryer support stand. Moreover, owing to their appearance and size, such stands must often be disassembled and/or stored after each use owing to the practical challenges identified above.
- Separately, there are solutions that must be drilled into the wall of a bathroom, creating both cosmetic and structural challenges to the user. Moreover, the limited range of motion of such mechanisms will often limit who can use a hair dryer support which is permanently or semi-permanently affixed to a wall: by way of example, the placement of the hair dryer on such a mechanism may be suitable for an individual who is five foot two in height. However, the same stand is unlikely to be suitable for a six foot three individual wishing to dry his or her hair as the hair dryer will likely sit too low in relation to such person's head in order to be usefully deployed to this end. These devices can therefore cause scarring to fixtures, are labor intensive to install, and are not adapted to the needs of a multi-user household or establishment.
- There is currently no solution in the market which is portable, reliably supports a wide range of hair dryer sizes and weights, does not cause damage to residential structures and walls, does not require disassembly and/or storage after each us, occupies no floor or counter space and is adjustable by its user to account for preferred height and angle adjustments.

Accordingly, there is a need for an apparatus for supporting a hand held hair dryer that solves the above described challenges, namely an apparatus that frees both of the user's hands while the appliance is in use, allowing the user to dry or style their hair, and that does not cause damage to walls, require the occupation of large amounts of space or operate reliably in conjunction with heavy dryers.

SUMMARY

The present disclosure provides a portable hair dryer support apparatus, comprising:

- a hair dryer holding structure for holding a hair dryer; and
- at least one vertical support element connected at a first end to the hair dryer holding structure and having at a second opposed end at least one securing portion for securing the portable hair dryer support apparatus to a door.

The present disclosure also provides a portable hair dryer support apparatus as above, wherein the hair dryer holding structure is pivotally connected to the at least one vertical support element via a hinge, which may be equipped with a suction cup, may also have a mirror pivotally attached thereon and may include a locking mechanism to lock the hair dryer holding structure at specific angles.

The present disclosure further provides a portable hair dryer support apparatus as above, wherein the hair dryer holding structure includes a pivoting hair dryer holder for example a ring with a pressurized rubber interior, and may include a rotating knob connected to an axis of rotation of the pivoting hair dryer holder in order to rotate the pivoting hair dryer holder to a desired angle.

The present disclosure still further provides a portable hair dryer support apparatus as above, wherein the at least one vertical support element includes a length adjustment mechanism, for example:

- a first and a second slidingly superimposed bars, the first bar having a series of holes along a portion of its length and the second bar having a protuberance configured to engage the holes in order to adjust a distance of the hair dryer holding structure from a top end of the door; or a first and a second slidingly superimposed bars, the first bar having an elongated slit along a portion of its length and the second bar having a knurled screw configured to slide within the slit and press the first and second bars against one another in order to adjust the distance of the tray from a top end of the door.

The present disclosure also provides a portable hair dryer support apparatus as above, wherein the hair dryer holding structure is selected from a group consisting of a tray, a rack, a holster, a flexible gooseneck tubing and a wrapped flexible metal holder, and includes at least one feature selected from a group consisting of a slit, a hole, a slat and a grass mat.

BRIEF DESCRIPTION OF THE FIGURES

Embodiments of the disclosure will be described by way of examples only with reference to the accompanying drawings, in which.

Similar references used in different Figures denote similar components.

DETAILED DESCRIPTION

Generally stated, the non-limitative illustrative embodiments of the present disclosure provide a portable apparatus for supporting a hand held hair dryer. More specifically, the present disclosure relates to a portable apparatus that can be hanged from a door for supporting a hand held hair dryer while the appliance is in use in order to free both of the user's hands for drying and styling of their hair. The hair dryer support apparatus can also act as a storage holder for the hair dryer itself and/or grooming articles and products such as combs, brushes, hair clips, etc., and, in an alternative embodiment, be provided with a mirror. This frees up counter space usually needed for some of the larger appliances or drawer space often taken up by some of the smaller appliances or grooming articles.

Figure 1:
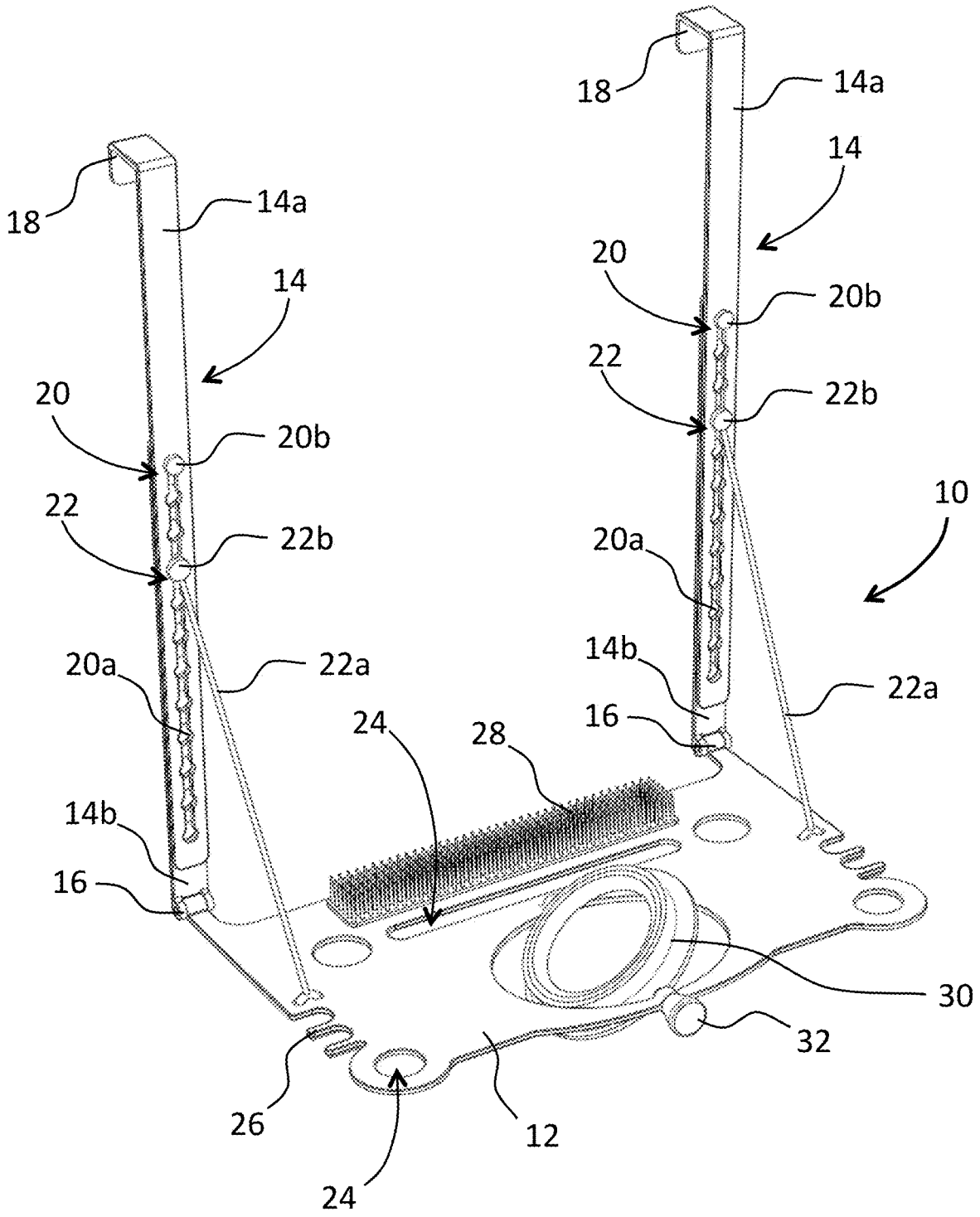
FIG. 1 is a perspective view of a portable apparatus for supporting a hand held hair dryer in a fully retracted configuration in accordance with an illustrative embodiment of the present disclosure.
Figure 2:
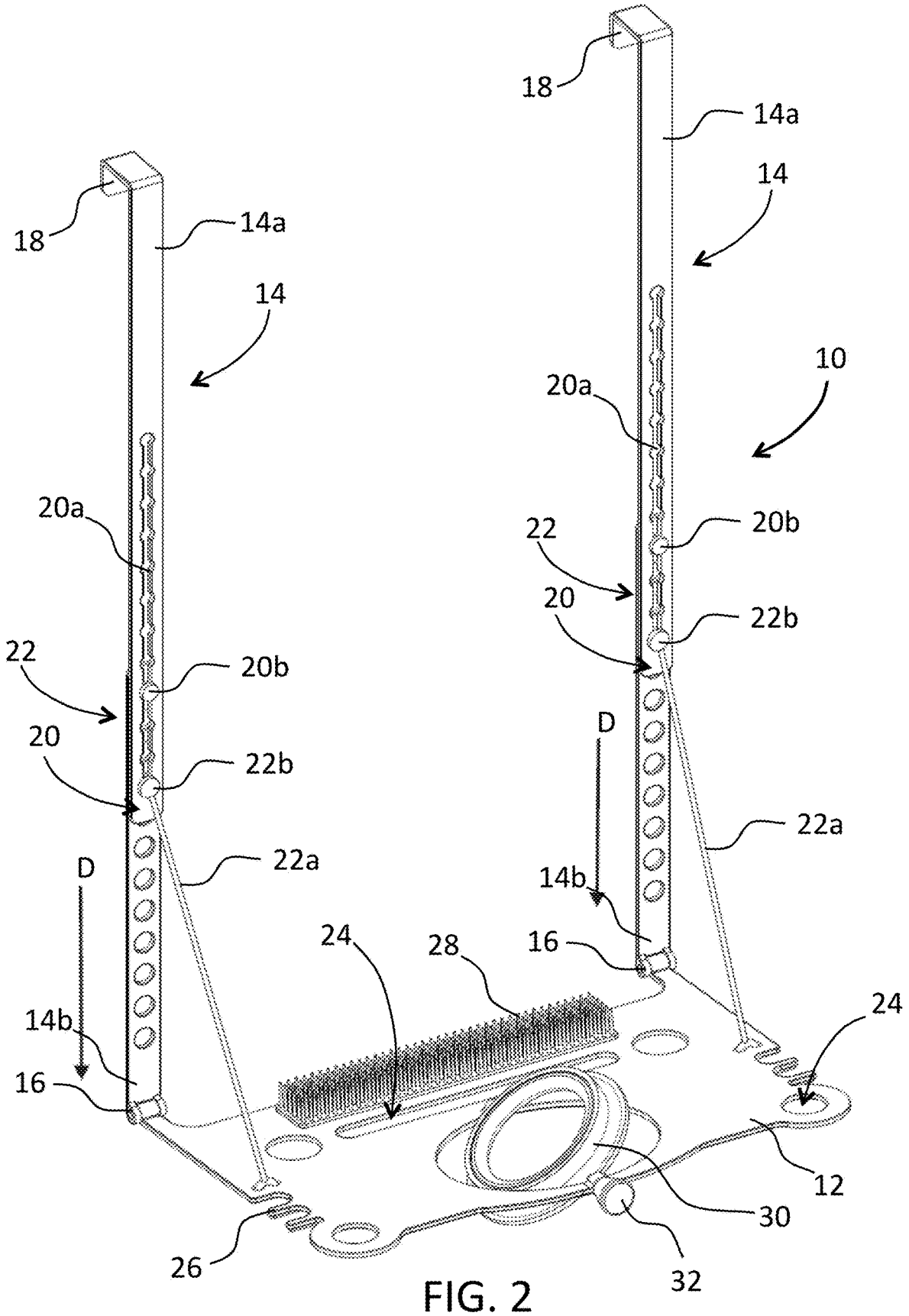
FIG. 2 is a perspective view of the portable apparatus for supporting a hand held hair dryer of FIG. 1 in a fully extended configuration.
Figure 3:
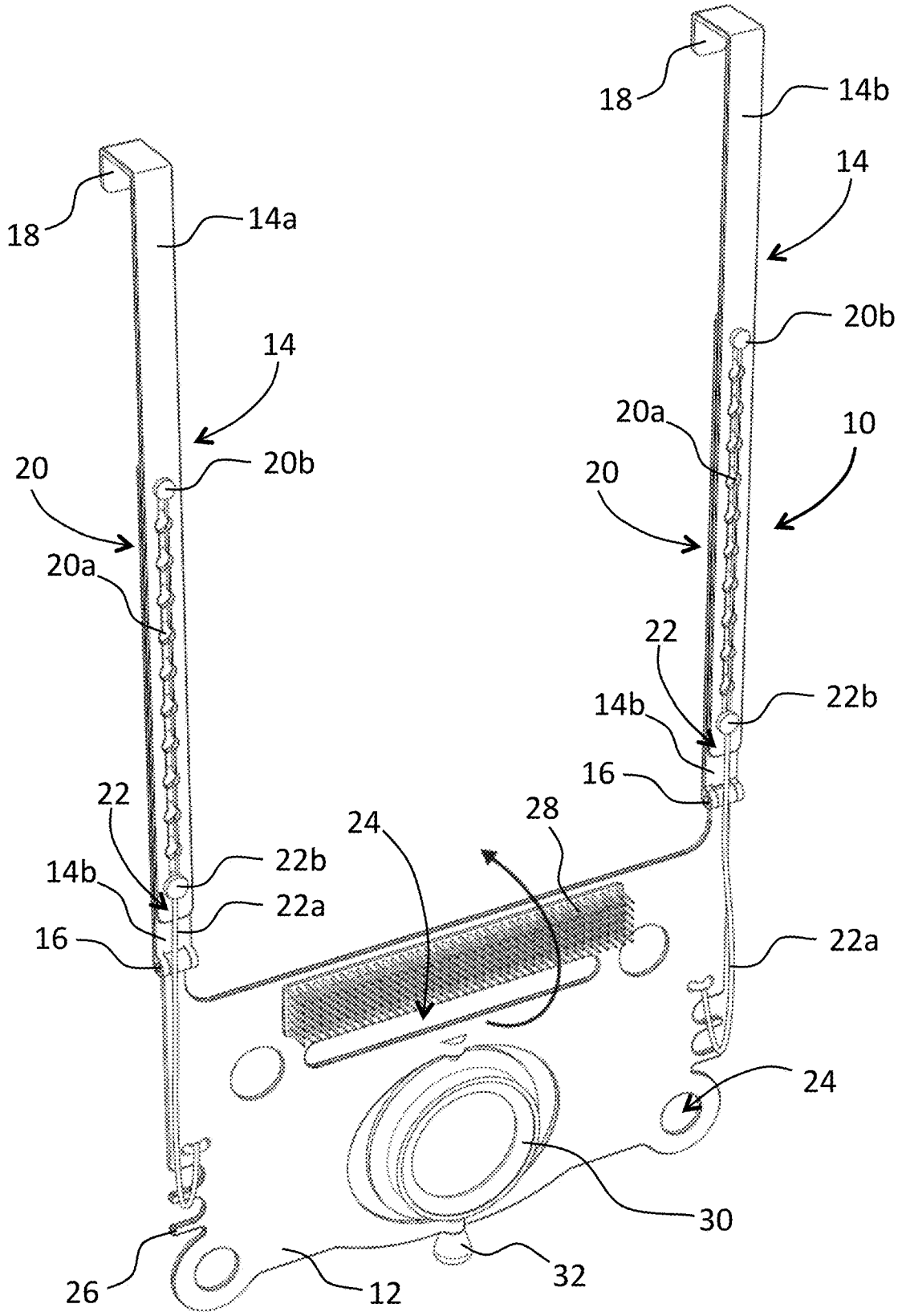
FIG. 3 is a perspective view of the portable apparatus for supporting a hand held hair dryer of FIG. 1 in a collapsed configuration.

Referring to FIGS. 1 to 3, there is shown a portable hair dryer support apparatus 10 in accordance with an illustrative embodiment of the present disclosure. The hair dryer support apparatus 10 includes hair dryer holding structure, in this case a tray 12 operatively connected at opposite ends to a pair of vertical support elements 14 via respective hinges 16.

It is to be understood that although in the illustrative embodiment the hair dryer holding structure is in the form of a tray 12, in alternative embodiments the hair dryer holding structure may be a rack, a holster, flexible gooseneck tubing, a wrapped flexible metal holder, etc.

Each vertical support element 14 is provided at an end opposed to the hinge 16 with a securing portion 18, for example a clip, hook, catch, grapple or other securing mechanism, to secure the portable hair dryer support apparatus 10 to a door, a length adjustment mechanism 20 and a tray angle adjustment mechanism 22.

The length adjustment mechanism 20, for example two slidingly superimposed bars 14*a*, 14*b*, forming the vertical support element 14, with a first bar 14*a* having a series of holes 20*a* along a portion of its length and a second bar 14*b* having a button 20*b* or other protuberance configured to engage the holes 20*a*, to adjust the distance of the tray 12 from the top of the door and consequently the floor, i.e. the positioning of the tray 12 along the vertical axis. FIG. 1 shows the portable hair dryer support apparatus 10 with the length adjustment mechanism 20 in a fully retracted configuration while FIG. 2 shows the portable hair dryer support apparatus 10 with the length adjustment mechanism 20 in a fully extended configuration.

The tray angle adjustment mechanism 22, for example a string 22*a*, cord, strand, etc., attached at one end to the tray 12 and engaged at an opposite end to the vertical support element 14 via a button 22*b* or other fastener engaging, for example, holes 20*a* in one of the slidingly superimposed bars 14*a* of the vertical support element 14. By adjusting the position at which the tray angle adjustment mechanism 22 engages the vertical support element 14, i.e. which hole 22*a* is engaged, the angle of the tray 12 with regard to the surface of the door can be adjusted, the tray 12 pivoting around the transverse axis via hinges 16. Referring to FIG. 3, when not in use, the tray 12 can be pivoted so as to lie in the same plane as the vertical support elements 14, thus collapsing the portable hair dryer support apparatus 10 so as to minimized the apace it occupies or for easy storage or transport.

The combination of the length adjustment mechanism 20, tray angle adjustment mechanism 22 and pivoting hair dryer holder 30 provides for a 3-degree of freedom movement of the nozzle of a supported hair dryer, i.e. along the vertical axis, around the transverse axis and around the sagittal axis with respect to the door the portable hair dryer support apparatus 10 is secured to. It is to be understood that one or more of the length adjustment mechanism 20, tray angle adjustment mechanism 22 and pivoting hair dryer holder 30 may be replaced by a fixed connection, in which case the nozzle of the hair dryer may have 2, 1 or 0 degrees of freedom movement. It is to be further understood that the tray 12 may be joined to vertical support elements 14 through a hinge or a locking mechanism which enables a user to lock the tray 12 at specific angles.

The tray 12 is provided with one of more slit or hole 24 for receiving therein the handle of a brush, the diameter of the slit or hole 24 being such as to be larger than the handle but smaller than the head of the brush, one of more slat 26 for engaging an opening in the handle of a brush, a grass mat 28 for holding therein various objects such as combs, hair clips, etc., and a hair dryer holder 30 in the form of a pivoting ring with a pressurized rubber interior so as to grab and hold the hair dryer, for example by inserting the nozzle of the hair dryer into the pivoting ring. The hair dryer holder 30 is pivotally connected to the tray 12 and is provided with a rotating knob 32, optionally threaded, connected to its axis of rotation (i.e. the sagittal axis perpendicular to the plane as the door) in order to rotate the hair dryer to a desired angle in a plane parallel to the door. In an alternative embodiment the hair dryer hair dryer holder 30 may be in the form of a cone, an iris diaphragm that can be closed so as to tighten around the hair dryer nozzle and hold it in place, etc. In further alternative embodiment the rotating knob 32 may be omitted.

Figure 4:
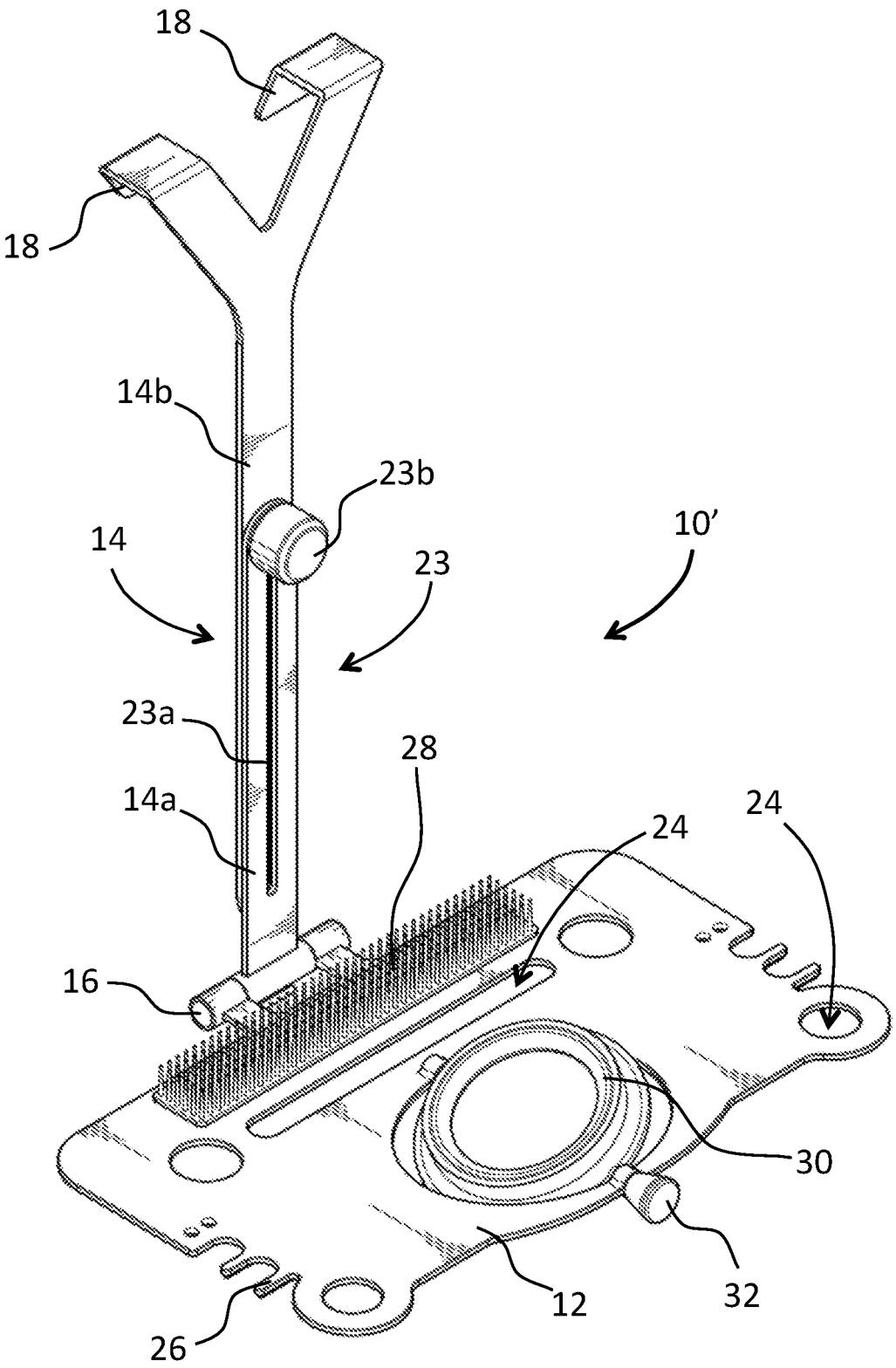
FIG. 4 is a perspective view of a portable apparatus for supporting a hand held hair dryer in a fully extended configuration in accordance with an alternative illustrative embodiment of the present disclosure.

It is to be understood that in an alternative embodiment a different number of vertical support elements 14 may be used. For example, referring to FIGS. 4 and 5, there is shown a portable hair dryer support apparatus 10' in accordance with an alternative embodiment in which the hair dryer support apparatus 10' is provided with a single vertical support element 14 positioned centrally with regard to the edges of the tray 12 and operatively connected to the tray 12 via hinge 16. The vertical support element 14 is provided at an end opposite the hinge 16 with a pair of spaced apart securing portions 18, for example clips, hooks, catches, grapples or other securing mechanism, to secure the portable hair dryer support apparatus 10' to a door and a length adjustment mechanism 23. In an alternative embodiment, the pair of spaced apart securing portions 18 may be replaced by a single securing portion, which may be wider in order to provide stability.

The length adjustment mechanism 23 is composed of a pair of slidingly superimposed bars 14*a*, 14*b*, forming the vertical support element 14, with a first bar 14*a* having an elongated slit or channel 23*a* along a portion of its length and a second bar 14*b* having a knurled screw or thumb screw 23*b* configured to slide within slit 23*a* and press the superimposed bars 14*a*, 14*b* against one another in order to adjust the distance of the tray 12 from the top of the door and consequently the floor.

The hinge 16 is provided with a locking mechanism that enables a user to lock the tray 12 at specific angles.

The other components of the portable hair dryer support apparatus 10', as well as their configuration, are similar to those of portable hair dryer support apparatus 10 previously described.

Figure 5:
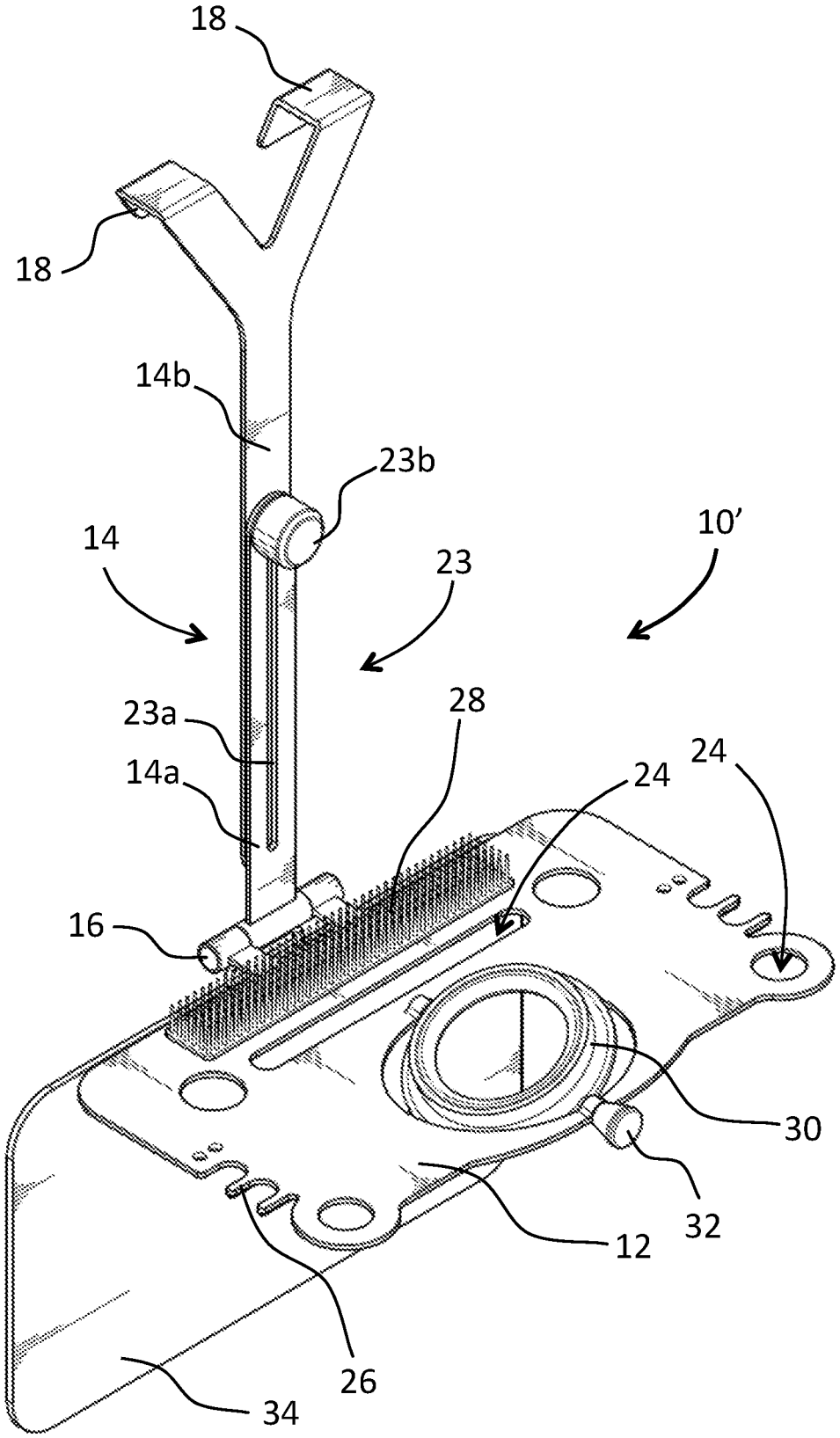
FIG. 5 is a perspective view of the portable apparatus for supporting a hand held hair dryer of FIG. 4 with an optional mirror.

Referring to FIG. 5, the portable hair dryer support apparatus 10' may optionally be provided with a pivoting mirror 34 attached beneath the hair dryer holding structure, in this case tray 12, via hinge 16 or a mirror securing mechanism which allows for the fastening or suspension of a mirror thereunder or thereto.

It is to be understood that similarly to portable hair dryer support apparatus 10', portable hair dryer support apparatus 10 may be provided with length adjustment mechanism 23 and/or pivoting mirror 34.

In other alternative embodiments the presence or absence, as well as the number, of slit or hole 24, slat 26 and/or grass mat 28 may vary. The tray 12 may also be provided with, or have features allowing for the attachment of, other storage, fastening or holding mechanisms for personal hygiene or hair products, accessories, grooming tools or devices, etc.

In further alternative embodiments the tray 12 may be in the form of a plateau without any slit or hole 24, slat 26 or grass mat 28, or a grid, both with an opening for receiving the hair dryer, or replaced by a flexible gooseneck tubing.

In a still further alternative embodiment, the tray 12 may be connected directly to the vertical support element(s) 14, in which case the portable hair dryer support apparatus 10, 10' may not be collapsible.

In yet another alternative embodiment, one or more hinge 16 may be equipped with a suction cup in order to provide added stability.

The portable hair dryer support apparatus 10, 10' can be made, for example, of a plastic material allowing the selection of various colors and the printing of graphics on any flat areas.

Although the present disclosure has been described with a certain degree of particularity and by way of an illustrative embodiments and examples thereof, it is to be understood that the present disclosure is not limited to the features of the embodiments described and illustrated herein, but includes all variations and modifications within the scope and spirit of the present disclosure and as hereinafter claimed.

What is claimed is:

1. A portable hair dryer support apparatus, comprising:

a hair dryer holding structure for holding a hair dryer;

at least one vertical support element pivotally and directly connected at a bottom end to the hair dryer holding structure via a hinge having an axis of rotation perpendicular to the at least one vertical support element, and having at a top opposed end at least one securing portion for hanging the portable hair dryer support apparatus from a door; and a mirror pivotally and directly attached to the hinge.

2. A portable hair dryer support apparatus in accordance with claim 1, wherein the hair dryer holding structure includes a pivoting hair dryer holder.

3. A portable hair dryer support apparatus in accordance with claim 2, wherein the pivoting hair dryer holder is a ring with a pressurized rubber interior.

4. A portable hair dryer support apparatus in accordance with claim 2, further comprising a rotating knob connected to an axis of rotation of the pivoting hair dryer holder in order to rotate the pivoting hair dryer holder to a desired angle.

5. A portable hair dryer support apparatus in accordance with claim 1, wherein the at least one vertical support element includes a length adjustment mechanism.

6. A portable hair dryer support apparatus in accordance with claim 5, wherein the length adjustment mechanism includes a first and a second slidingly superimposed bars, the first bar having an elongated slit along a portion of its length and the second bar having a knurled screw configured to slide within the slit and press the first and second bars against one another in order to adjust the distance of the hair dryer holding structure from a top end of the door.

7. A portable hair dryer support apparatus in accordance with claim 1, wherein the at least one securing portion is selected from a group consisting of a clip, a hook, a catch and a grapple.

8. A portable hair dryer support apparatus in accordance with claim 1, wherein the hair dryer holding structure includes at least one feature selected from a group consisting of a slit, a hole, a slat and a grass mat.

9. A portable hair dryer support apparatus in accordance with claim 1, wherein the hair dryer holding structure is selected from a group consisting of a tray, a rack, a holster, a flexible gooseneck tubing and a wrapped flexible metal holder.

10. A portable hair dryer support apparatus, comprising:

a hair dryer holding structure in the form of a vertically pivoting tray for holding a hair dryer; and at least one vertical support element pivotally and directly connected at a bottom end to the tray via a hinge having an axis of rotation perpendicular to the at least one vertical support element, and having at a top opposed end at least one securing portion for hanging the portable hair dryer support apparatus from a door; and a mirror pivotally and directly attached to the hinge.

11. A portable hair dryer support apparatus in accordance with claim 10, wherein the tray includes a pivoting hair dryer holder.

12. A portable hair dryer support apparatus in accordance with claim 11, wherein the pivoting hair dryer holder is a ring with a pressurized rubber interior.

13. A portable hair dryer support apparatus in accordance with claim 11, further comprising a rotating knob connected to an axis of rotation of the pivoting hair dryer holder in order to rotate the pivoting hair dryer holder to a desired angle.

14. A portable hair dryer support apparatus in accordance with claim 10, wherein the at least one vertical support element includes a length adjustment mechanism.

15. A portable hair dryer support apparatus in accordance with claim 14, wherein the length adjustment mechanism includes a first and a second slidingly superimposed bars, the first bar having an elongated slit along a portion of its length and the second bar having a knurled screw configured to slide within the slit and press the first and second bars against one another in order to adjust the distance of the tray from a top end of the door.

16. A portable hair dryer support apparatus in accordance with claim 10, wherein the hair dryer holding structure includes at least one feature selected from a group consisting of a slit, a hole, a slat and a grass mat.

* * * * *